US005551856A

United States Patent [19]

Katagiri

[11] Patent Number: 5,551,856

[45] Date of Patent: Sep. 3, 1996

[54] APPARATUS FOR CONNECTING PUNCHES IN POWDER MOLDING PRESS MACHINE

[75] Inventor: Takeshi Katagiri, Machida, Japan

[73] Assignee: Yoshizuka Seiki Co., Ltd., Kawasaki, Japan

[21] Appl. No.: 145,532

[22] Filed: Nov. 3, 1993

[30] Foreign Application Priority Data

Nov. 5, 1992 [JP] Japan ..... 4-319227

[51] Int. Cl.[6] ..... B22F 3/02

[52] U.S. Cl. ..... 425/78; 425/195; 425/352; 425/356

[58] Field of Search ..... 425/78, 193, 195, 425/352, 354, 355, 356

[56] References Cited

U.S. PATENT DOCUMENTS

| | | | |
|---|---|---|---|
| 3,353,215 | 11/1967 | Haller | 425/78 |
| 3,593,366 | 7/1971 | Smith | 425/195 |
| 3,664,785 | 5/1972 | Marshall et al. | 425/78 |
| 3,843,287 | 10/1974 | Fowler | 425/352 |
| 4,392,800 | 7/1983 | Apuzzo | 425/352 |
| 5,326,242 | 7/1994 | Katagiri et al. | 425/355 |

FOREIGN PATENT DOCUMENTS

| | | | |
|---|---|---|---|
| 62-101398 | 5/1987 | Japan | 425/352 |
| 1-317700 | 12/1989 | Japan . | |

*Primary Examiner*—C. Scott Bushey

*Attorney, Agent, or Firm*—Armstrong, Westerman, Hattori, McLeland & Naughton

[57] ABSTRACT

A powder molding press machine is provided with a main body, a plurality of punches provided for the main body and punch operating means for operating the punches. The plurality of punches are assembled into a punch unit so as to allow the punches to move reciprocally, the punch operating units are attached to the main body for individually reciprocating each of the plurality of punches, the operating units having operational end portions corresponding to the plurality of punches. The punch unit is rotated relative to the punch operating units so as to connect the plurality of punches to the corresponding operational end portions.

7 Claims, 5 Drawing Sheets

APPARATUS FOR CONNECTING PUNCHES IN POWDER MOLDING PRESS MACHINE

BACKGROUND OF THE INVENTION

The present invention relates to a powder molding pressing machine and, more particularly, to a method and apparatus for connecting a plurality of punches to a main body of the pressing machine.

In a tool-set type pressing machine having a plurality of punches for forming, for example, a double or triple punch pressing machine, it is necessary to operate each of the punches separately and independently from the other punches, and accordingly, such a pressing machine comprises, as shown in FIG. 5, a punch operating device 101 including a hydraulic cylinder or an air cylinder, and an auxiliary device, in addition to a pressurizing device 100 provided in the main body of the pressing machine.

In a conventional pressing machine, the punch operating device 101 and, further, an upper punch unit 103 including a plurality of punches are assembled into a tool set 102.

Punches and other components are assembled as follows. A third lower punch 107, a second lower punch 106, a first lower punch 105 and then a die 108 are sequentially connected vertically in this order below a core 104, and the core 104 and the die 108 are then raised to connect a third upper punch 111 to the tool set 102 while it is axially aligned with the core 104. After a second punch 110 is connected, a first punch 109 is connected while it is being positioned relative to the die 108.

However, in the conventional tool-set type pressing machine, each of the first, second and third upper punches 109, 110 and 111 of the upper punch unit 103 must be fastened by a bolt inserted from below, thus reducing the assembling efficiency.

Furthermore, if only the third upper punch 111, provided substantially at the center of the tool set 102, needs to be replaced, the first and second upper punches 109, 110 must also be detached, in other words, the whole upper unit 103 must be disassembled and then assembled again after such replacement, thus considerably degrading the working efficiency in replacement or maintenance.

It is normal practice for such a tool-set type pressing machine that punches are assembled into a tool set separately from the main body of the machine. More specifically, a plurality of tool sets having punches of various shapes and sizes are prepared beforehand, and a tool set suitable for a desired product is selectively attached to the main body of the pressing machine. Because a plurality of tool sets are needed for this normal practice, the production cost is thereby inevitably raised.

Particularly, a tool set having a plurality of punches needs rather sophisticated and therefore expensive operating and auxiliary devices for the punches, thus further pushing up the production cost.

Furthermore, it is necessary for the punch operating device and the auxiliary device to arrange an air or hydraulic piping system, so that the pipes must be connected every time a tool set is replaced, thus making such tool-set replacement troublesome and time-consuming.

In addition, since a large-size pressing machine requires a hydraulic system and, therefore, is provided with wide pipes, the tool-set replacement is even more difficult in such a large machine. Further, the piping system may be contaminated with undesired substances during replacement.

SUMMARY OF THE INVENTION

Accordingly, an object of the present invention is to substantially eliminate defects or drawbacks encountered in the prior art described above and to provide a method and apparatus for connecting punches in a powder molding press machine, in which a device for operating a plurality of punches, for example, two or three punches, is provided in the main body of the press machine, thereby reducing the cost of a tool set and facilitating the replacement of punches.

This and other objects can be achieved according to the present invention by providing, in one aspect, a method for connecting punches in a powder molding press machine provided with a main body, a plurality of punches provided for the main body and punch operating means for operating the punches, comprising the steps of:

assembling the plurality of punches into a punch unit so as to allow the punches to move reciprocally;

attaching the punch operating means to the main body for individually reciprocating each of the plurality of punches, the operating means having operational end portions corresponding to the plurality of punches; and rotating the punch unit relative to the punch operating means so as to connect the plurality of punches to the corresponding operational end portions.

In another aspect, there is provided an apparatus for connecting punches in a powder molding press machine having a main body, comprising;

a punch unit having a plurality of punches assembled so as to allow the punches to move reciprocally; and punch operating means for individually reciprocating each of the plurality of punches, provided in the main body of the powder molding press machine, the operating means having operational end portions corresponding to the plurality of punches, wherein each of the operational end portions includes connecting means for connecting the corresponding punch by rotating the punch unit relative to the punch operating means.

In a preferred embodiment, the connecting means has a plurality of annular clampers which are coaxially assembled to be axially movable but unrotatable relatively to one another, the clampers being provided with connecting end portions of the clampers, and the connecting end portions of the punches have inserting portions and receiving portions which are detachably connected to each other, the inserting portions and the receiving portions respectively having connecting teeth which are engaged with and disengaged from each other by rotating the punches relative to the clampers.

The apparatus further comprises moving means for moving the punch unit to and from the connector means and rotating means for rotating the clampers. The punch unit is moved by the moving means until the inserting portions is inserted into the receiving portions of the connecting portions of the punches and the clampers are positioned adjacent to each other and wherein the connecting teeth of the inserting portions and the receiving portions are engaged with and disengaged from each other by rotating the clampers rotated by said rotating means with the the inserting portions and the receiving portions being held in the inserted state.

In a further preferred embodiment, the punch unit includes first, second and third punches concentrically with each other in which the third punch is most inwardly arranged, the second punch is fitted over an outer periphery of the third punch and the first punch is fitted over an outer periphery of the second punch to be axially slidable, the first, second and third punches being respectively secured by means of first, second and third punch holders. The inserting portions include first, second and third inserting portions provided for axially upper ends of the first, second and third punch holders, respectively. The first, second and third inserting portions annularly project from the upper ends of the first, second and third punch holders and each of the inserting portions is formed with engaging teeth formed along a circumferential direction thereof so as to projecting radially inwardly.

According to the present invention, means for operating a plurality of punches is provided in the main body of the press machine, and a punch unit is connected to an operating end portion of the operating means. When the punches are to be replaced, the punch unit is detached from the operating means and another punch unit is connected to the same operating means.

According to this structure, since a plurality of punches are assembled into a punch unit, connection of the punches can be easily achieved. Further, since the upper punch unit is provided separately from the punch operating means, each of the combined punches of the unit can be handled from the above when the upper punch unit is separated from the punch operating means.

Even a punch positioned close to the center of the punch unit can be easily adjusted without having to detach the other punches.

Further objects, features and advantages of the present invention will become apparent from the following description of the invention with reference to the accompanying drawings.

BRIEF DESCRIPTION OF THE DRAWINGS

In the accompanying drawings:

FIGS. 1A and 1B are sectional views of an embodiment of the punch connecting apparatus of a powder molding press machine of the present invention, in which FIG. 1A illustrates a state thereof before a punch unit is connected and FIG. 1B illustrates a state thereof after the punch unit is connected;

FIGS. 3A to 3D illustrate an upper punch unit, in which FIG. 3A is a vertical sectional view thereof, FIG. 3B is a top plan view, FIG. 3C is a perspective view of a connecting portion of the upper punch unit and FIG. 3D illustrates the arrangement of rotation stopping pins and springs;

FIGS. 4A and 4B illustrate the clamper unit used in the apparatus shown in FIGS. 1A and 1B, in which FIG. 4A is a vertical sectional view thereof and FIG. 4B is a plan view of a connecting end portion of the clamper unit.

DESCRIPTION OF THE PREFERRED EMBODIMENT

One preferred embodiment of the present invention will be described hereinafter with reference to the drawings.

FIGS. 1 to 4 represent a tool-set type powder molding press machine employing an embodiment of the method and apparatus for connecting punches in a powder molding press machine of the present invention. In this embodiment, the present invention is applied for the connection of an upper unit contained in a tool set to the main body of the press machine.

Figure 1B:
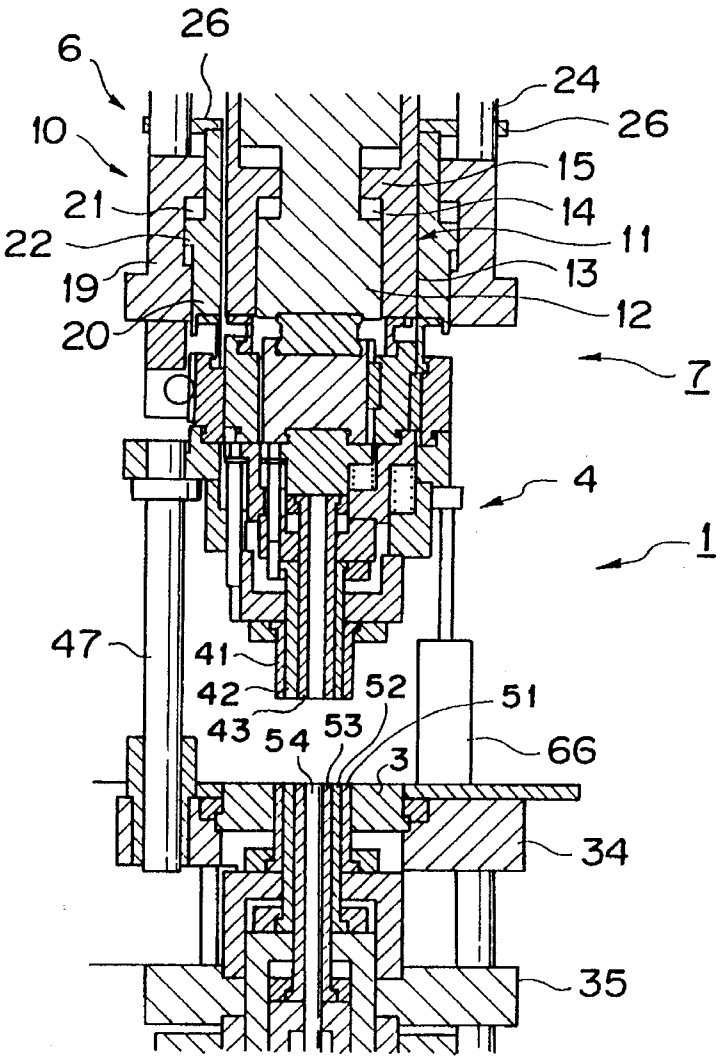
Figure 1A:
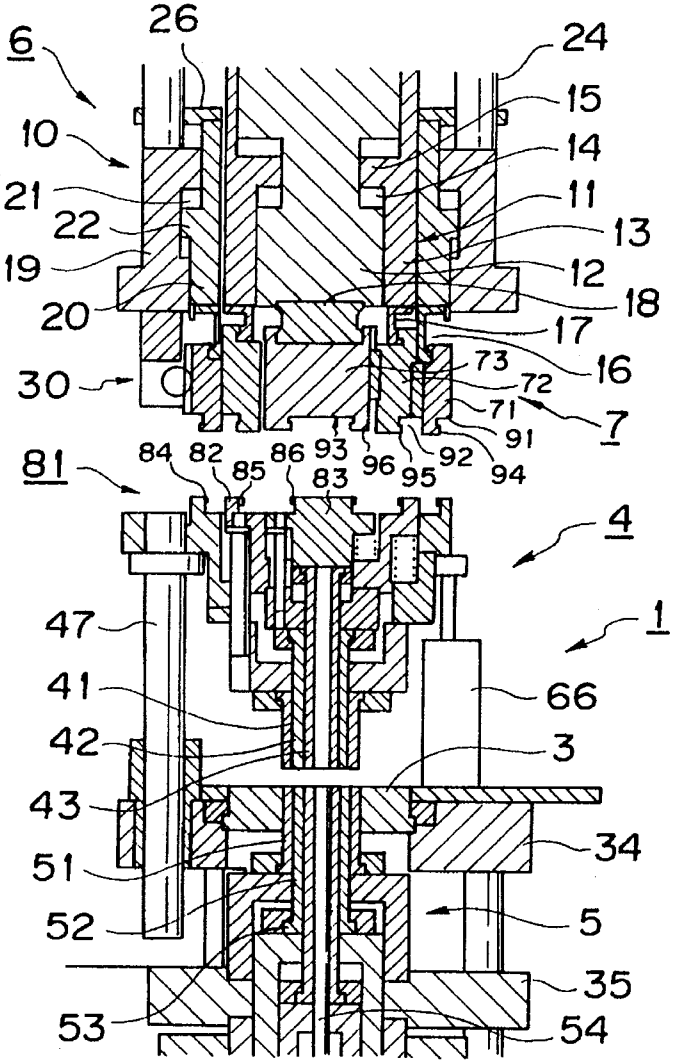
Figure 2:
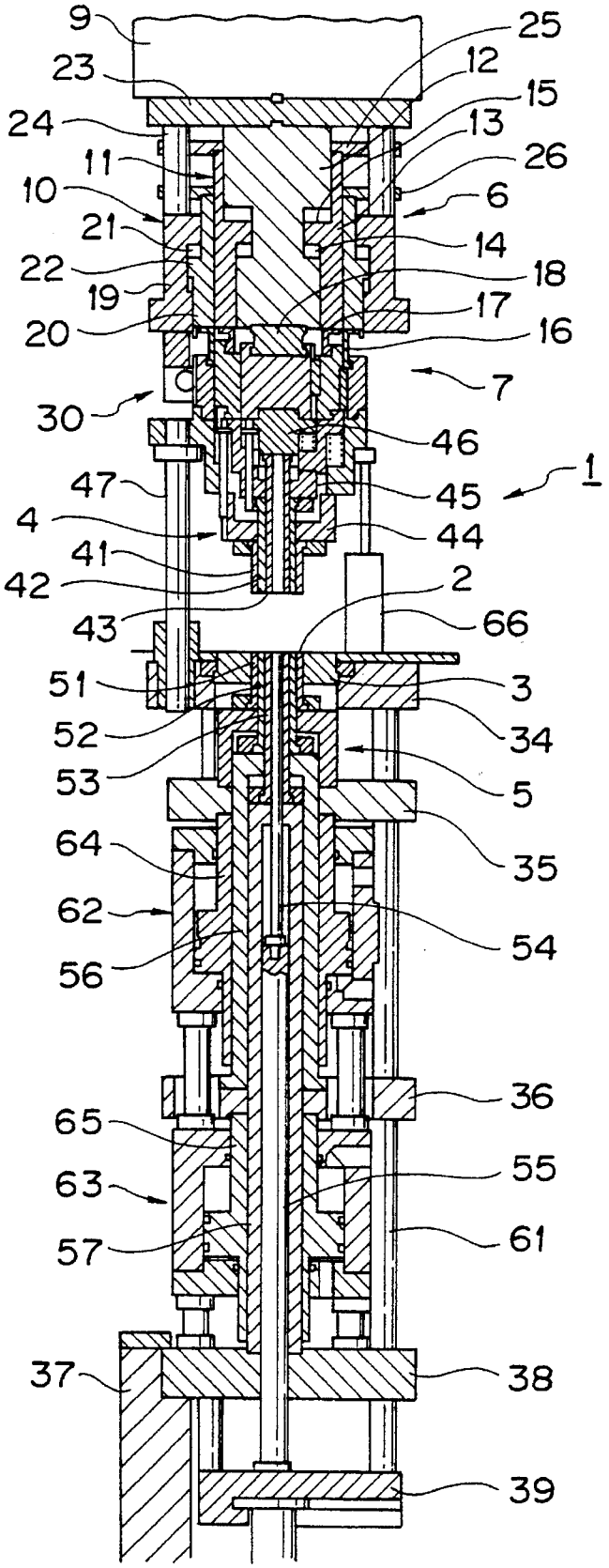
FIG. 2 is a sectional view of a tool set employing the embodiment as shown in FIGS. 1A and 1B.

Referring to FIGS. 1A, 1B and FIG. 2, a tool set 1 comprises a die 3 which has a die hole 2 and is to be filled with powder, an upper punch unit 4 which is pressured so as to enter an upper opening of the die 3, and a lower punch unit 5 which is pressured so as to enter a lower opening of the die 3.

A punch connecting apparatus to which the upper punch unit 4 is connected is essentially composed of a punch operating unit 6 and a clamper unit 7 which are connected to the main body of the press machine.

As illustrated in FIGS. 3A to 3D, the upper unit 4 comprises first, second and third upper punches 41, 42 and 43 which are coaxially assembled. The third upper punch 43 is located to the innermost position. The second upper punch 42 is slidably fitted over the outer peripheral surface of the third upper punch 43. The first upper punch 41 is slidably fitted over the outer peripheral surface of the second upper punch 42. The first, second and third upper punches 41, 42 and 43 are fastened to first, second and third upper punch holders 44, 45 and 46, respectively.

The third upper punch holder 46 is a solid cylindrical member having a third flange 46*a* extending from an upper portion thereof. The second and first upper punch holders are hollow tubular members. The second punch holder 45 is fitted over the peripheral surface of the third upper punch holder 46. The first upper punch holder 44 is fitted over the outer peripheral surface of the second upper punch holder 45. Each of the first and second upper punch holders 44 and 45 has a stepped tubular shape in which the diameter thereof increased toward the upper end, stepwise at two portions. First and second flanges 44*a* and 45*a* extend from the upper ends of the first and second upper punch holders 44 and 45, respectively. The first flange 44*a* of the first upper punch holder 44 is fixed to an upper end portion of a guide shaft 47 which guides the entire upper punch unit 4.

In order to prevent the first, second and third upper punch holders 44, 45 and 46 from rotating, rotation stopping pins 48*a* and 48*b* are inserted between the first and second upper punch holders 44 and 45, and between the second and third upper punch holders 45 and 46, respectively. The rotation stopping pins 48*a* and 48*b* also serve to guide vertical movements of these upper punch holders.

The upper ends of the first, second and third upper punch holders 44, 45 and 46 are provided with first, second and third inserting portions 81, 82 and 83, respectively, for connecting to the clamper unit 7.

The third inserting portion 83 has a circular shape protruding from the upper end of the third upper punch holder 46. The third inserting portion 83 has third engaging teeth 86 which are circumferentially arranged at a predetermined pitch and radially projected outward from the circumferential portion thereof.

The second inserting portion 82 has a ring-like shape protruding upward from the upper end of the second upper punch holder 45. The second inserting portion 82 has second engaging teeth 85 which are circumferentially arranged at a predetermined pitch and radially projected inward from the circumferential portion thereof.

The first inserting portion 81 has a ring-like shape protruding upward from the upper end of the first upper punch holder 44. The first inserting portion 81 has second engaging teeth 84 which are circumferentially arranged at a predetermined pitch and radially projected inward from the circumferential portion thereof.

In order to support the second and third upper punch holders 45 and 46, springs 49*a* and 49*b* are provided between the first and second upper punch holders 44 and 45, and between the second and third punch holders 45 and 46, respectively. The restoration force of the springs 49*a* and 49*b* prevents the second and third upper punch holders 45 and 46 from falling and descending, thereby fixing the second and third inserting portions 82 and 83 in position even when these punch holders are not connected to the clamper unit 7.

Instead of the springs 49*a* and 49*b*, air pressure may be utilized. Further, a pin may be temporarily inserted through the first, second and third upper punch holders 44, 45 and 46 to maintain the holders in position. In addition, instead of providing means for preventing the upper punch holders from descending, the punch operating unit 6 may be designed so that each of the operating end portions can be projected to offset a descent of the corresponding punch holder.

Figure 3A:
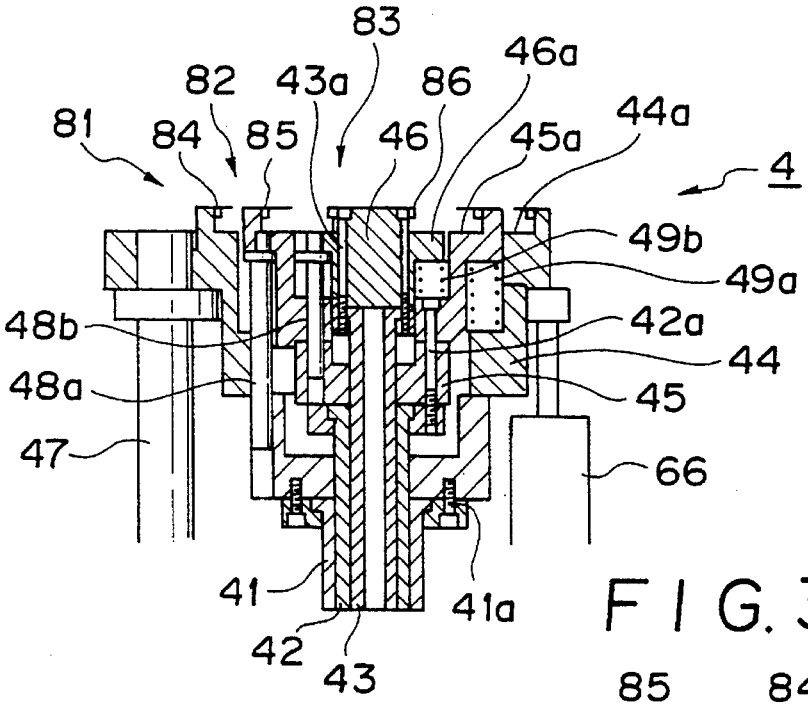
Figure 3B:
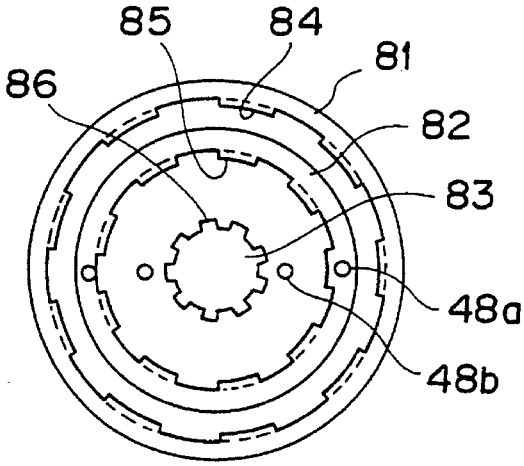
Figure 3C:
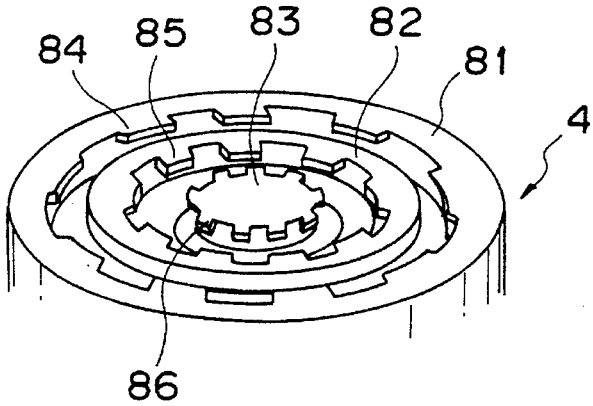
Figure 3D:
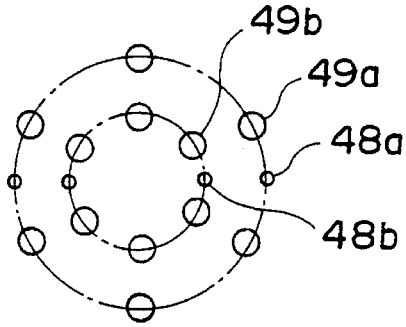

In this embodiment, the numbers of the springs 49*a* and 49*b* are six each, and the springs 49*a* and 49*b* are equidistantly arranged, as shown in FIG. 3D. The numbers of the rotation pins 48*a* and 48*b* are two each.

As illustrated in FIG. 3, the second and third upper punches 42 and 43, positioned relatively inside the upper punch unit 4, are assembled in such a manner as to facilitate the pulling-up of the punches from the upper punch unit 4, as indicated above and illustrated in detail in FIG. 3. Further, these upper punches are fastened to the above-situated second and third upper punch holders 45 and 46 by means of bolts 42*a* and 43*a*, respectively, which are inserted from the upper ends of the holders into the punches. Therefore, the second and third upper punches 42 and 43 can be easily pulled out for replacement, and positionally adjusted with respect to the lower punch unit 5 simply by handling the punches 42 and 43 from the above, for example, using the bolts 42*a* and 43*a*.

Although, in FIG. 3, the first upper punch 41, that is, the outermost upper punch, is fastened to the first upper punch holder 44 by means of bolts 41*a* inserted from an upper portion of the first upper punch 41 up into the holder 44, the first upper punch 41 may also be connected to the holder 44 by bolts inserted from the holder 44 down into the punch 41.

As shown in FIGS. 1A, 1B and FIG. 2, the punch operating unit 6 comprises first and second upper punch operating means 10 and 11 for operating the first and second upper punches 41 and 42, respectively. The first and second upper punch operating means 10 and 11 are coaxially arranged. Third upper punch operating means for operating the third upper punch 43 is formed by pressurizing means of the main body of the press machine.

The second upper punch operating means 11 comprises a second stationary member 12, that is, a solid member positioned substantially at the center of the punch operating means 11, and a second movable member 13, that is, a tubular member slidably and fluid-tightly fitted over the outer peripheral surface of the second stationary member 12. A second operational chamber 14 into which operational fluid, such as pressured oil or air, flows is formed around the outer peripheral surface of a substantially middle portion of the second stationary member 12. The second movable member 13 has a second ring-like piston portion 15 protruding from the inner peripheral surface thereof into the second operational chamber 14 so as to divide the second operational chamber 14 into two chambers. The second stationary member 12 is fastened at the lower end thereof to a solid third adapter 18. The second movable member 13 is fastened at an operational lower end portion thereof to a solid second adapter 17.

The first upper punch operating means 10 comprises a tubular first stationary member 19 fastened to an upper ram 9 of the main body of the press machine and a tubular first movable member 20 slidably and fluid-tightly fitted on the inner peripheral surface of the first stationary member 19. A first operational chamber 21 into which operational fluid, such as pressured oil or air, flows is formed around the inner peripheral surface of a substantially middle potion of the first stationary member 19. The first movable member 20 has a first ring-like piston portion 22 protruding from the outer peripheral surface thereof into the first operational chamber 21 so as to divide the first operational chamber 21 into two chambers. The first movable member 20 is fastened at the lower end thereof to an annular first adapter 16.

The first and second stationary members 19 and 12 of the first and second upper punch operating means 10 and 11 connected to the upper ends to each other by a stationary plate 23. More specifically, the second stationary member 12 is fixed at the upper end directly to the stationary plate 23, and the first stationary member 19 is connected to the stationary plate 23 by means of fixing rods 24. The fixing rods 24 extend along the movement axis of the first and second movable members 20, 13 and slidably penetrate through first and second movable plates 25, 26 connected to the upper end portions of the first and second movable members 20, 13.

Figure 4A:
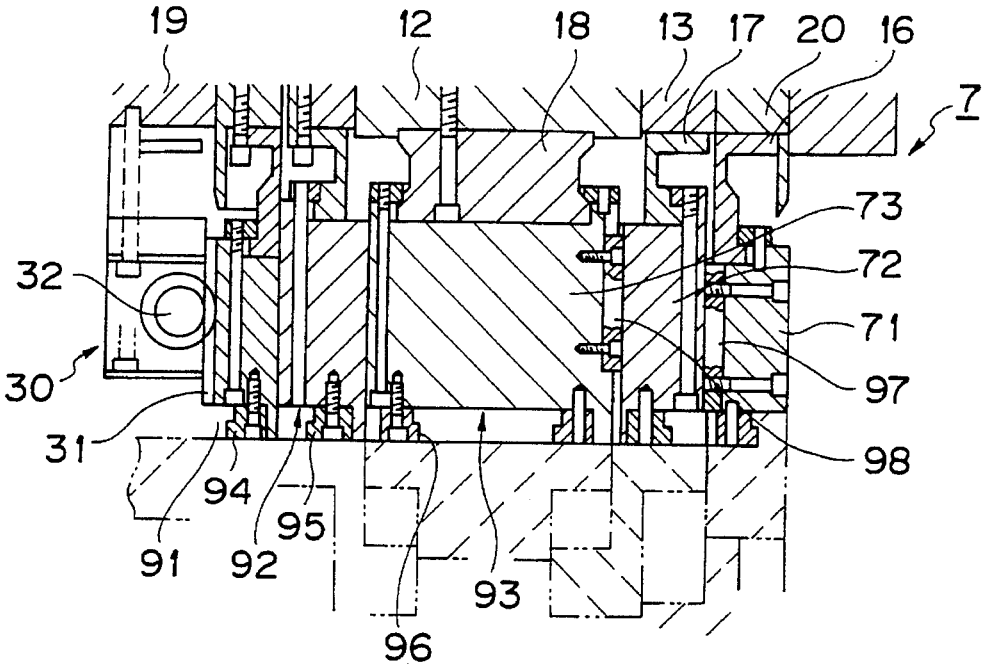
Figure 4B:
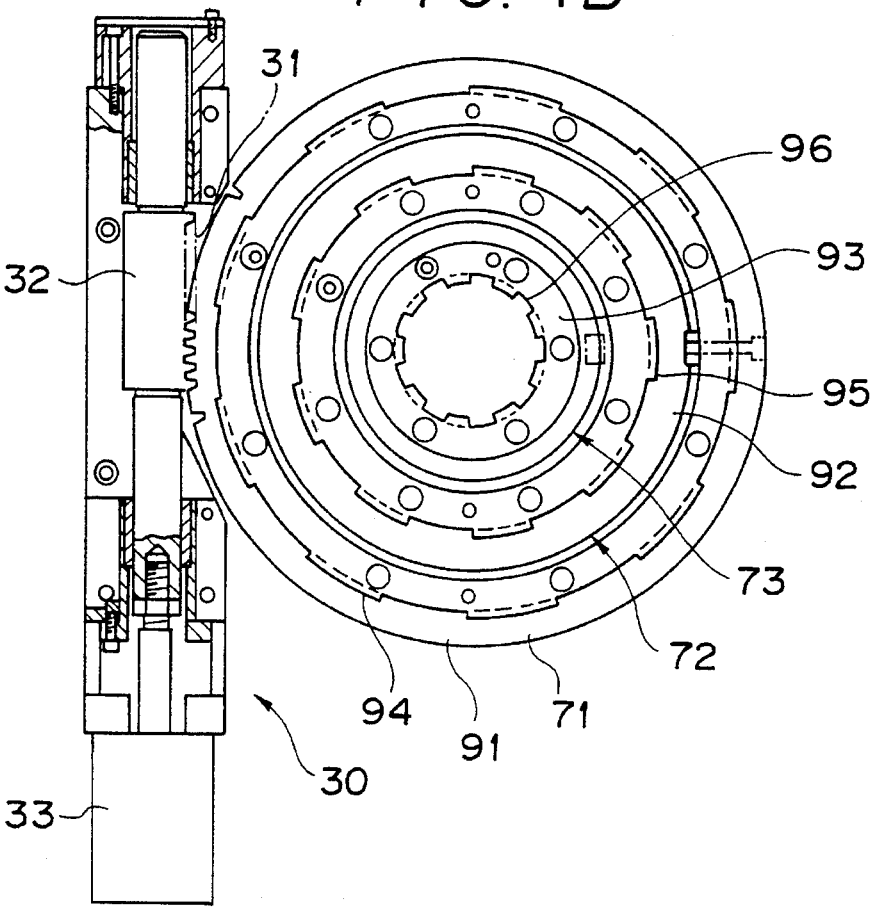
Figure 5:
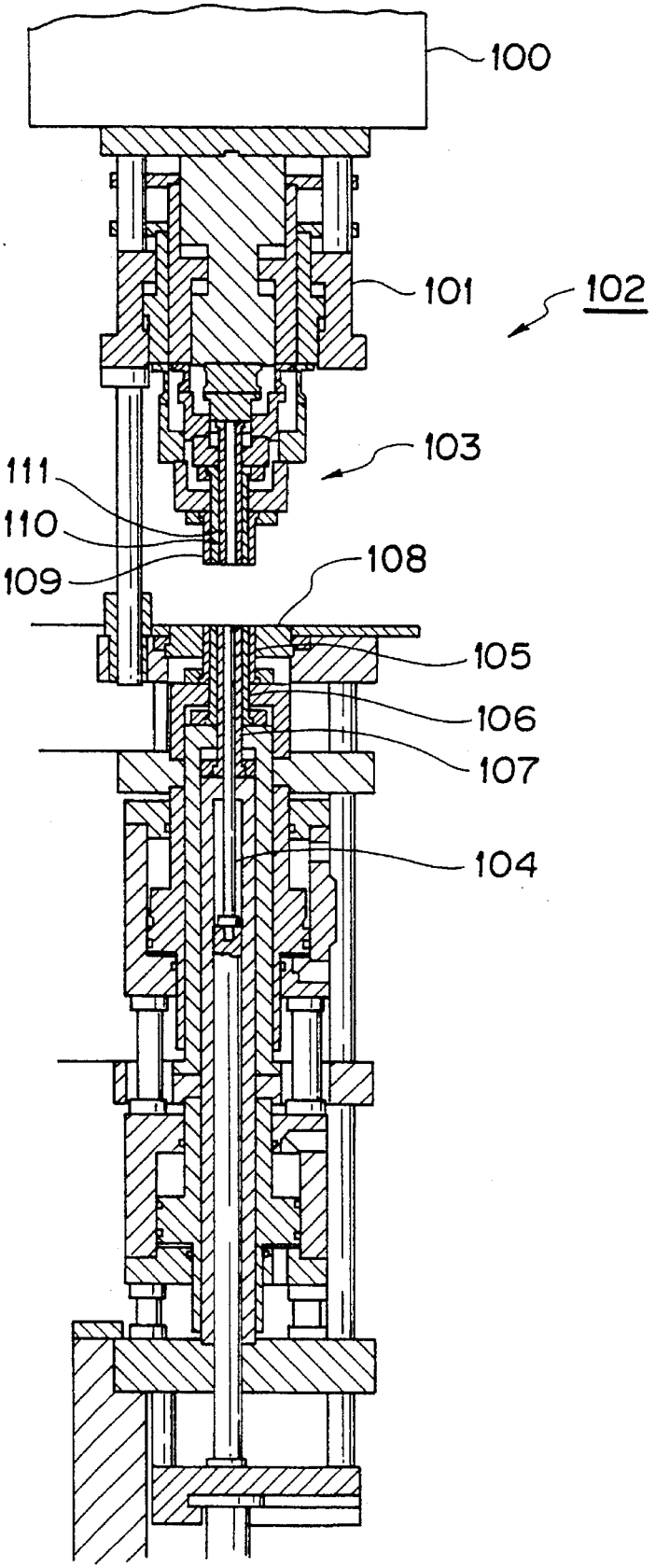
FIG. 5 PRIOR ART
FIG. 5 is a sectional view of a conventional tool set of a powder molding press machine.

Referring to FIG. 1A and FIG. 4, the clamper unit 7 comprises tubular first and second clampers 71 and 72 and a solid cylindrical third clamper 73 which are coaxially assembled. The second clamper 72 is axially movably fitted over the outer peripheral surface of the solid cylindrical third clamper 73. The first clamper 71 is axially movably fitted over the outer peripheral surface of the second clamper 72.

The third clamper 73 is rotatably connected at the upper end thereof to the third adapter 18 fastened to the lower end of the second stationary member 12 of the punch operating unit 6.

The second clamper 72 is rotatably connected at the upper end thereof to the second adapter 17 fastened to the lower end of the second movable member 13 of the punch operating unit 6.

The first clamper 71 is rotatably connected at the upper end thereof to the first adapter 16 fastened to the lower end of the first movable member 20 of the punch operating unit 6.

A lower end portion of the third clamper 73 is provided with a third receiving recess portion 93 which engages with the third inserting portion 83 provided in an upper end portion of the third upper punch holder 46. The inner periphery of a lower end portion of the third receiving recess portion 93 is provided with third receiving teeth 96 circumferentially arranged at a predetermined pitch.

A lower end portion of the second clamper 72 is provided with a second receiving portion 92 which engages with the second inserting portion 82 provided in an upper end portion of the second upper punch holder 45. The outer periphery of a lower end portion of the second receiving portion 92 is provided with second receiving teeth 95 circumferentially arranged at a predetermined pitch.

A lower end portion of the first clamper 71 is provided with a first receiving portion 91 which engages with the first inserting portion 81 provided in an upper end portion of the first upper punch holder 44. The outer periphery of a lower end portion of the first receiving portion 91 is provided with first receiving teeth 94 circumferentially arranged at a predetermined pitch.

The first, second and third clampers 71 and 72 and 73 are stopped from rotating relatively to one another by keys 97 and 98 provided between the first and second clampers 71 and 72, and between the second and third clampers 72 and 73, respectively. Accordingly, these clampers are unrotatable relatively to one another, but axially movable relatively to one another. However, the clamper unit 7 as a whole is rotatable. Due to the location of the rotation stopping members such as the keys 97 and 98, the first, second and third receiving teeth 94 and 95 and 96 of the first, second and third clampers 71 and 72 and 3 are maintained in the same phase relation.

The clamper unit 7 is provided with rotating means 30 for rotating the clamper unit 7.

The rotating means 30 comprises driven teeth 31 formed around the outer periphery of the first clamper 71, a rack 32 engaged with the driven teeth 31, and a reciprocating cylinder 33 for moving the rack 32 back and forth. A portion of the rotating means 30 is connected to the first stationary member 19 of the punch operating unit 6.

The upper punch unit 4 is assembled together with the lower punch unit 5 into the tool set 1.

The tool set 1 comprises a die plate 34 having a die 3 which will be filled with powder, a first lower punch plate 35 provided under the die plate 34 for supporting a first lower punch 51, a second punch plate 36 provided under the first lower punch plate 35 for supporting a second lower punch 52, a stationary plate 38 fixed to a frame 37 of the press machine main body, and a pull-down plate 39 which is provided under the stationary plate 38 and connected to the die plate 34 by means of tie rods 61. The first and second lower punch plates 35 and 36 are slidably penetrated by the tie rods 61. The tool set 1 further comprises a third lower punch 53, a core rod 54 fitted on the inner peripheral surface of the third lower punch 53, and a core rod holder 5 connecting the lower end of the core rod 54 to the pull-down plate 39.

Furthermore, the first lower punch driving cylinder 62 for operating the first lower punch 51 is provided between the first and second lower punch plates 35 and 36. A second lower punch driving cylinder 63 for operating the second lower punch 52 is provided between the second lower punch plate 36 and the stationary plate 38.

The first and second punch driving cylinders 62 and 63 have annular first and second piston rods 64 and 65, respectively. A third lower punch holder 57 for the third lower punch 53 is fitted on the inner peripheral surface of the second piston rod 65 of the second lower punch driving cylinder 63. A second lower punch holder 56 for the second lower punch 52 is fitted on the inner peripheral surface of the first piston rod 64 of the first lower punch driving cylinder 62.

The upper punch unit 4 is fixed to an upper end portion of the guide shaft 47, which penetrates the die plate 34. The upper punch unit 4 is thus supported by the die plate 34.

The die plate 34 is provided with a vertically driving cylinder 66 for raising and lowering the upper punch unit 4 so as to move the unit 4 to and from the clamper unit 7.

The upper punch unit 4 of the powder molding press machine is connected to the clamper unit 7 as follows.

First, the tool set 1 is connected to the main body of the press machine main body as shown in FIG. 1A.

Second, the upper punch unit 4 is raised to the clamper unit 7 by operating the vertically driving cylinder 66 so as to insert the first, second and third inserting portions 81, 82 and 83 of the first, second and third upper punch 41, 42 and 43 into the first, second and third receiving portions 91, 92 and 93 of the first, second third clampers 71, 72 and 73.

Third, the rack 32 is linearly moved by means of the cylinder 33 of the rotating means 30 so that the clamper unit 7 is rotated by the engagement between the rack 32 and the driven teeth 31. Thereby, the first, second and third receiving teeth 94, 95 and 96 of the clamper unit 7 become engaged with the first, second and third engaging teeth 84, 85 and 86 of the upper punch unit 4. In this embodiment as shown in the figures, because the numbers of the first, second and third engaging teeth 84, 85 and 86 are nine each, they come into the engagement by rotating the clamper unit 7 by an angle of 20°.

Although the tool set 1 in this embodiment is a hydraulic type, a mechanically operated tool set may be employed according to the present invention.

As described above, according to the present invention, since the punch unit is separated from the punch operating means, each of the punches combined into a unit can be handled from the above, thereby enhancing the working efficiency in the connection, replacement and maintenance of the punches. Furthermore, since a punch positioned inside the unit can be easily adjusted without having to detach the other punches or disassemble the unit, thereby further enhancing the working efficiency.

Still furthermore since the punches assembled into a unit can be connected to the operational end portions of the punch operating means, which is connected to the main body of the press machine, by one action, the working efficiency can be substantially enhanced over the conventional art wherein each of a plurality of punches must be connected while positioning thereof is achieved.

In addition, since the punch operating means fastened to the main body of the press machine can be used for connecting various punch units, the required costs can be substantially reduced compared with the conventional art where punch operating means must be provided for each punch unit.

Still furthermore, since the punch operating means fastened to the main body can be used for connecting various punch units, there is no need to connect pipes every time punches are replaced, thereby reducing the amount of time required for replacement.

It is to be understood that the present invention is not limited to the disclosed embodiments and many other changes and modifications may be made without departing from the scopes of the appended claims.

What is claimed is:

1. An apparatus for connecting punches in a powder molding press machine having a main body, comprising:

a punch unit having a plurality of punches assembled so as to allow the punches to move reciprocally; and punch operating means in said main body of said powder molding press for individually reciprocating each of said plurality of punches, said punch operating means having a plurality of operational end portions each corresponding to a respective one of the plurality of punches, wherein each of said operational end portions includes connecting means for connecting and disconnecting the corresponding punch by rotating the punch unit relative to the punch operating means.

2. An apparatus according to claim 1, wherein said connecting means has a plurality of annular clampers which are coaxially assembled to be axially movable but unrotatable relative to one another, said annular clampers and said punch unit having connecting end portions in the form of teeth for locking said clampers to said punches by a relative rotation between said clampers and said punch unit such that the teeth of each of the respective clampers and punch unit are passable between the teeth of the other and, by relative rotation of said clampers and said punch unit, the teeth on said clampers and said punch unit are brought into alignment and engaged to grip one another and thereby clamp the respective punches into operating position.

3. An apparatus according to claim 2, further comprising moving means for moving said connecting end portions of said punch unit to and from said connecting end portions of said clampers and rotating means for rotating said clampers, wherein said punch unit is moved by said moving means until inserting portions of the connecting end portions of said punch unit are inserted into receiving portions of said connecting end portions of the clampers and wherein said connecting teeth of the inserting portions and the receiving portions are engaged with and disengaged from each other by rotating the clampers, rotated by said rotating means, with said inserting portions and said receiving portions held in an inserted state.

4. An apparatus according to claim 3, wherein said punch unit includes first, second and third punches arranged concentrically with each other in which the third punch is most inwardly arranged, the second punch is fitted over an outer periphery of the third punch and the first punch is fitted over an outer periphery of the second punch to be axially slidable, said first, second and third punches being respectively secured by means of first, second and third punch holders.

5. An apparatus according to claim 4, said inserting portions include first, second and third inserting portions provided on axially upper ends of the first, second and third punch holders, respectively.

6. An apparatus according to claim 5, wherein the first, second and third inserting portions annularly project from the upper ends of the first, second and third punch holders and each of said inserting portions is formed with engaging teeth formed along a circumferential direction thereof so as to project radially.

7. An apparatus for connecting punches in a powder molding press machine comprising a punch unit including a plurality of punches assembled so as not to be concentrically relatively rotatable and to be reciprocal in an axial direction thereof, a punch operating unit including a plurality of punch operating means each for individually performing a reciprocal operation of an individual punch so as not to be concentrically relatively rotatable, and a punch connection unit including a plurality of connection means provided at operational end portions of the respective punch operating means, wherein the respective punches of said punch unit are withdrawn from and plugged into the connection means of the corresponding punch operating means, and connection end portions of the respective punches of the punch unit are together mounted and dismounted with respect to the connection means of the respective punch operating means through the relative rotation between the connection means provided at the operational end portions of the punch operating means and the connection end portions of the respective punches.

* * * * *